US006796062B1

(12) United States Patent
deKoevend

(10) Patent No.: US 6,796,062 B1
(45) Date of Patent: Sep. 28, 2004

(54) TRAFFIC SIGN

(76) Inventor: Ronald deKoevend, 719 Centrauri Dr., Grand Junction, CO (US) 81506

( * ) Notice: Subject to any disclaimer, the term of this patent is extended or adjusted under 35 U.S.C. 154(b) by 0 days.

(21) Appl. No.: 10/439,378

(22) Filed: May 16, 2003

(51) Int. Cl.[7] ..... G09F 21/02

(52) U.S. Cl. ..... 40/586; 40/479; 40/612; 116/63 P

(58) Field of Search ..... 40/479, 582, 586, 40/610, 612, 617; 116/63 R, 63 P, 173; 840/908

(56) References Cited

U.S. PATENT DOCUMENTS 4,800,834 A * 1/1989 Feng ..... 116/173
4,944,656 A * 7/1990 Feng et al. ..... 116/173
5,755,051 A 5/1998 Zumbuhl
D405,377 S 2/1999 Davis
6,035,567 A 3/2000 Cameron
6,104,313 A * 8/2000 Boyd, II ..... 40/610
6,134,819 A 10/2000 McClain et al.
6,155,197 A * 12/2000 Stanley ..... 40/610
6,204,777 B1 3/2001 Lyons
6,266,903 B1 7/2001 Collins
6,363,641 B1 4/2002 Martinez

* cited by examiner

*Primary Examiner*—S. Joseph Morano
*Assistant Examiner*—Lars A. Olson

(57) ABSTRACT

A traffic sign includes an elongated pole having a top end and a bottom end. The pole is substantially hollow and the top end is open. A panel has a first side, a second side and a peripheral edge. The first side has a first indicia positioned thereon and the second side has a second indicia positioned thereon. A spindle is rotatably mounted in the pole and extends outwardly from the top end of the pole. The spindle is attached to the peripheral edge such that the peripheral edge is positioned generally adjacent to is top end of is pole. A biasing member is positioned in the pole and is mechanically coupled to the spindle for biasing rotation of the spindle in a first direction. A locking assembly selectively locks the panel in and releases the panel from a stationary position. The panel rotates when the locking assembly is released from the stationary position.

6 Claims, 3 Drawing Sheets

TRAFFIC SIGN

BACKGROUND OF THE INVENTION

1. Field of the Invention

The present invention relates to traffic directing devices and more particularly pertains to a new traffic directing device which is handheld, portable device for directing traffic on a work site.

2. Description of the Prior Art

The use of traffic directing devices is known in the prior art. U.S. Pat. No. 5,755,051 describes a device that includes a sign and light combination. Other such sign and light combinations include U.S. Pat. Nos. 6,134,819, 6,035,567, and 6,266,903. The lights aid in the viewing of the portable road signs to which they are attached.

While these devices fulfill their respective, particular objectives and requirements, the need remains for a device that includes lightweight materials and includes a sign that automatically rotates for the user of the sign.

SUMMARY OF THE INVENTION

The present invention meets the needs presented above by providing a double sided sign having a means for automatically rotating the sign.

Another object of the present invention is to provide a new traffic directing device that includes a device constructed of lightweight materials such as aluminum so that the device is easy to hold and carry.

To this end, the present invention generally comprises an elongated pole having a top end and a bottom end. The pole is substantially hollow and the top end is open. A panel has a first side, a second side and a peripheral edge. The first side has a first indicia positioned thereon and the second side has a second indicia positioned thereon. A spindle is rotatably mounted in the pole and extends outwardly from the top end of the pole. The spindle is attached to the peripheral edge such that the peripheral edge is positioned generally adjacent to is top end of is pole. A biasing member is positioned in the pole and is mechanically coupled to the spindle for biasing rotation of the spindle in a first direction. A locking assembly selectively locks the panel in and releases the panel from a stationary position. The panel rotates when the locking assembly is released from the stationary position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
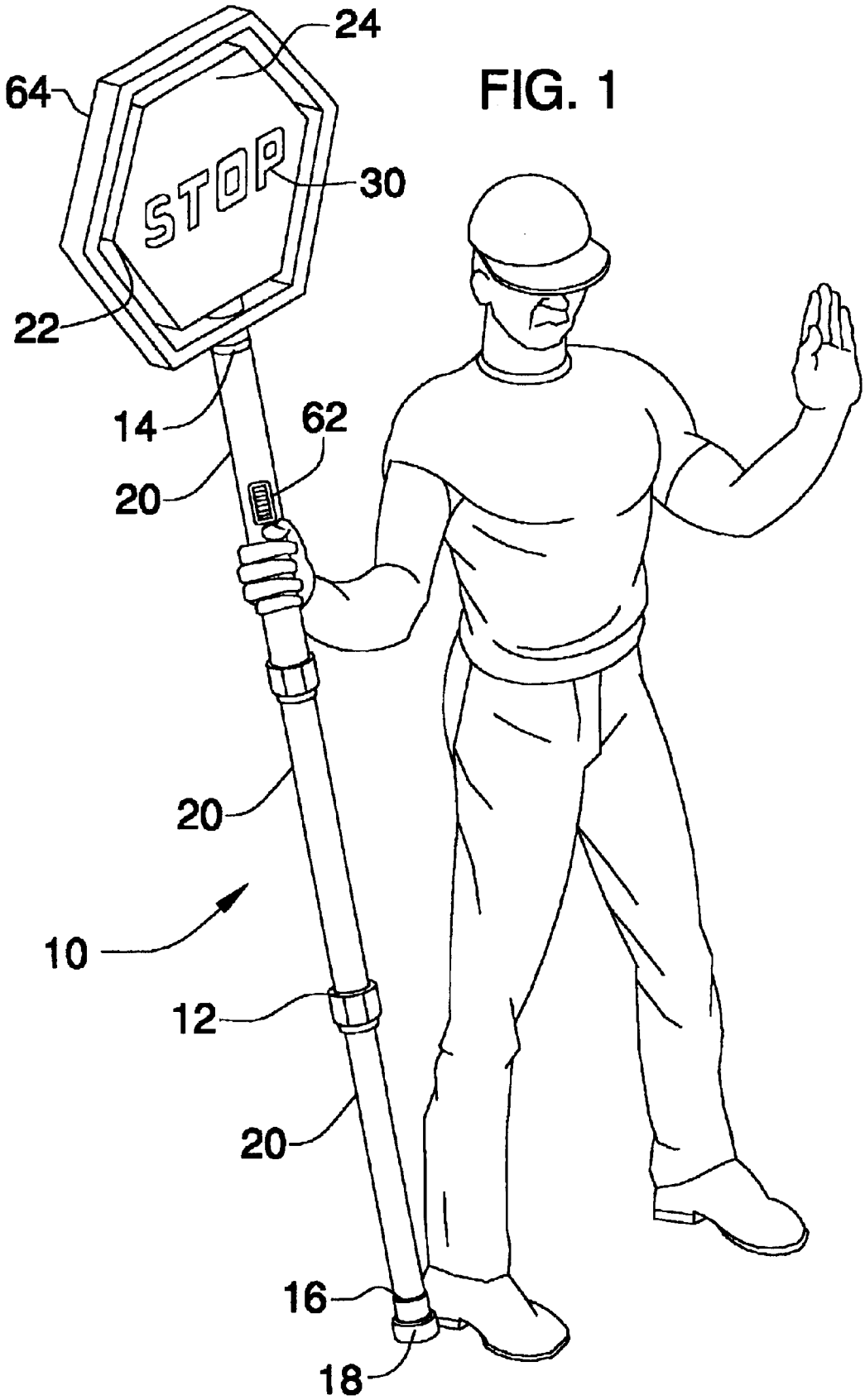
FIG. 1 is a schematic perspective in-use view of a traffic sign according to the present invention.
Figure 2:
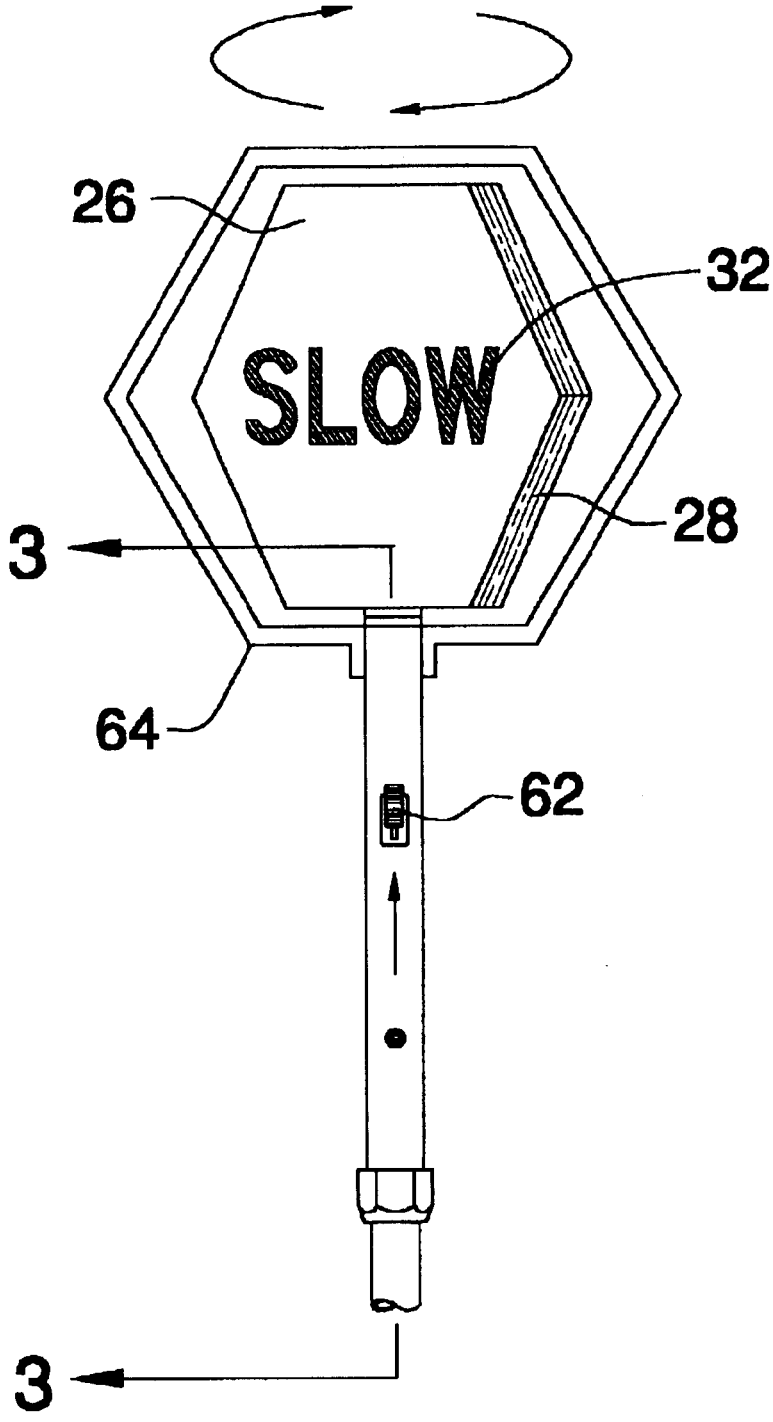
FIG. 2 is a schematic front elevated view of the present invention.
Figure 3:
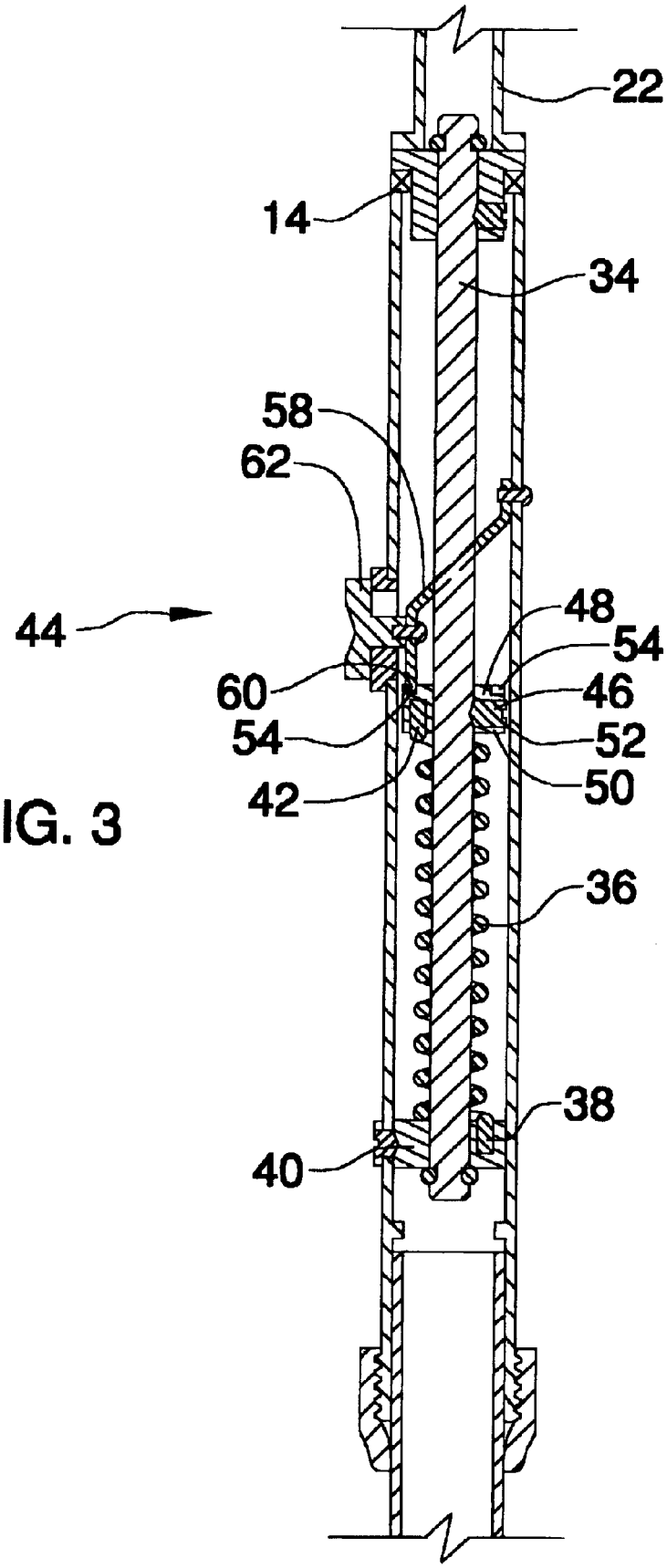
FIG. 3 is a schematic cross-sectional view taken along line 3—3 of FIG. 2 of the present invention.

With reference now to the drawings, and in particular to FIGS. 1 through 3 thereof, a new traffic directing device embodying the principles and concepts of the present invention and generally designated by the reference numeral 10 will be described.

As best illustrated in FIGS. 1 through 3, the traffic sign 10 generally comprises an elongated pole 12 having a top end 14 and a bottom end 16. The pole 12 is substantially hollow and the top end 14 is open. The pole 12 preferably comprises an aluminum material because of its rigid and lightweight properties. Preferably, an elastomeric covering 18, or foot, is positioned on and attached to the bottom end 16 of the pole 12. Ideally, the pole 12 is a telescoping pole or includes a plurality of sections 20 which may be removed from each other so the device 10 may be stored in an efficient manner.

A panel 22 has a first side 24, a second side 26 and a peripheral edge 28. The first side 24 has a first indicia 30 positioned thereon and the second side 26 has a second indicia 32 positioned thereon. The first indicia preferably indicates stop. The second indicia may include any one of a plurality of phrases including slow, go or yield. The panel 22 is preferably comprises of an aluminum material which is hollowed out.

A spindle 34 is rotatably mounted in the pole 12 and extends outwardly from the top end 14 of the pole 12. The spindle 34 is attached to the peripheral edge 28 such that the peripheral edge 28 is positioned generally adjacent to the top end 14 of the pole 12.

A biasing member 36 is positioned in the pole 12 and is mechanically coupled to the spindle 34 for biasing rotation of the spindle 34 in a first direction. The biasing member 36 preferably includes a spring wound about the spindle 34. The spring, or biasing member 36, includes one end 38 attached to a fixed position 40 and a second end 42 mechanically coupled to the spindle 34.

A locking assembly 44 selectively locks the panel 22 in and releases the panel 22 from a stationary position. The panel 22 rotates when the locking assembly 44 is released from the stationary position. One preferred version of the locking assembly 44 includes a disc 46 that is positioned in the pole 12. The spindle 34 extends through an axis of the disc 46 and is attached to the disc 46. The disc 46 has a first side 48, a second side 50 and a perimeter edge 52. The first side 48 has a pair of depressions 54 therein. The depressions 54 are positioned opposite with respect to each other so that the spindle 34 is between the pair of depressions 54. The biasing member 36 is attached to the disc 46. A detent 58 is mounted in the pole 12. The detent 58 has a free end 60 biased toward the first side 48 of the disc 46 such that the free end 60 extends into one of the pair of depressions 54 to define the stationary position. The detent 58 of FIG. 3 has a bend therein, not shown, so that is may extend around the spindle 34. A switch 62 is mounted on the pole 12 and extends therethrough. The switch 62 is attached to the detent 58. The switch 62 is selectively positionable away from the disc 46 such that the detent 58 is removed from the depressions 56.

Preferably, a frame 64 is attached to the pole 12. The frame 64 extends around the panel 22 such that the frame 64 and the panel 22 are substantially co-planar when the panel 22 is in the stationary position.

In use, the user of the device 10 turns the panel 22 in a second direction so that the biasing member 36 is wound tightly. When the user wishes to show the other side of the panel 22, the switch 62 is moved away from the disc 46 so that the detent 58 is removed from the depression 54 in which it is positioned. This causes the spindle 34, and disc 46 to which it is attached, to rotate in the first direction. The user releases the switch 62 so that the detent 58 enters the opposite depression 54 when the panel 22 has turned 180 degrees. The user repeats this step as needed. When the panel 22 no longer turns, the user winds up the biasing member 36 again by rotating the panel 22 in the second direction.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A traffic sign assembly comprising:

an elongated pole having a top end and a bottom end, said pole being substantially hollow, said top end being open;

a panel having a first side, a second side and a peripheral edge, said first side having a first indicia positioned thereon, said second side having a second indicia positioned thereon;

a spindle being rotatably mounted in said pole and extending outwardly from said top end of said pole, said spindle being attached to said peripheral edge such that said peripheral edge is positioned generally adjacent to said top end of said pole;

a biasing member being positioned in said pole and being mechanically coupled to said spindle for biasing rotation of said spindle in a first direction; and a locking assembly for selectively locking said panel in and releasing said panel from a stationary position, wherein said panel rotates when said locking assembly is released from said stationary position.

2. The traffic sign assembly of claim 1, wherein said pole comprises an aluminum material.

3. The traffic sign assembly of claim 1, wherein said locking assembly includes:

a disc being positioned in said pole, said spindle extending through an axis of said disc, said spindle being attached to said disc, said disc having a first side, a second side and a perimeter edge, said first side having a pair of depressions therein, said depressions being opposite with respect to each other, said biasing member being attached to said disc;

a detent being mounted in said pole, said detent having a free end biased toward said first side of said disc such that said free end extends into one of said pair of depressions to define said stationary position; and a switch being mounted on said pole and extending therethrough, said switch being attached to said detent, said switch being selectively positionable away from said disc such that said detent is removed from said depressions.

4. The traffic sign assembly of claim 1, further including a frame being attached to said pole, said frame extending around said panel such that said frame and said panel are substantially co-planar when said panel is in said stationary position.

5. The traffic sign assembly of claim 1, further including an elastomeric covering being positioned on and attached to said bottom end of said pole.

6. A traffic sign assembly comprising:

an elongated pole having a top end and a bottom end, said pole being substantially hollow, said top end being open, said pole comprising an aluminum material;

a panel having a first side, a second side and a peripheral edge, said first side having a first indicia positioned thereon, said second side having a second indicia positioned thereon;

a spindle being rotatably mounted in said pole and extending outwardly from said top end of said pole, said spindle being attached to said peripheral edge such that said peripheral edge is positioned generally adjacent to said top end of said pole;

a biasing member being positioned in said pole and being mechanically coupled to said spindle for biasing rotation of said spindle in a first direction;

a locking assembly for selectively locking said panel in and releasing said panel from a stationary position, wherein said panel rotates when said locking assembly is released from said stationary position, said locking assembly including;

a disc being positioned in said pole, said spindle extending through an axis of said disc, said spindle being attached to said disc, said disc having a first side, a second side and a perimeter edge, said first side having a pair of depressions therein, said depressions being opposite with respect to each other, said biasing member being attached to said disc;

a detent being mounted in said pole, said detent having a free end biased toward said first side of said disc such that said free end extends into one of said pair of depressions to define said stationary position;

a switch being mounted on said pole and extending therethrough, said switch being attached to said detent, said switch being selectively positionable away from said disc such that said detent is removed from said depressions;

a frame being attached to said pole, said frame extending around said panel such that said frame and said panel are substantially co-planar when said panel is in said stationary position; and an elastomeric covering being positioned on and attached to said bottom end of said pole.

* * * * *